US008302793B2

(12) United States Patent
Schorner

(10) Patent No.: US 8,302,793 B2
(45) Date of Patent: Nov. 6, 2012

(54) CLOSURE WITH SUPPORT ARRANGEMENT

(75) Inventor: Horst Schorner, Königsbach-Stein (DE)

(73) Assignee: Sanner GmbH, Bensheim (DE)

( * ) Notice: Subject to any disclaimer, the term of this patent is extended or adjusted under 35 U.S.C. 154(b) by 990 days.

(21) Appl. No.: 11/650,679

(22) Filed: Jan. 5, 2007

(65) Prior Publication Data

US 2007/0170193 A1 Jul. 26, 2007

(30) Foreign Application Priority Data

Jan. 5, 2006 (DE) ..... 10 2006 000 921

(51) Int. Cl.

| | |
|---|---|
| ***B65D 41/56*** | (2006.01) |
| ***B65D 51/00*** | (2006.01) |
| ***B65D 43/14*** | (2006.01) |
| ***B65D 39/00*** | (2006.01) |
| ***B65D 41/00*** | (2006.01) |
| ***B65D 43/00*** | (2006.01) |
| ***B65D 47/00*** | (2006.01) |
| ***B65D 1/09*** | (2006.01) |
| ***B65D 83/04*** | (2006.01) |

(52) U.S. Cl. ..... 215/231; 215/236; 220/212; 220/833; 220/908.2; 206/528; 206/540

(58) Field of Classification Search ..... 220/212, 220/738, 740, 833, 836, 837, 839, 908.2, 220/915.2; 215/236, 231; 221/65, 199, 205, 221/283; 206/528, 538, 540
See application file for complete search history.

(56) References Cited

U.S. PATENT DOCUMENTS

| | | | | |
|---|---|---|---|---|
| 2,767,864 | A | 11/1952 | Van Litsenburg | |
| 3,768,636 | A | 10/1973 | O'Connell, Jr. | |
| 4,221,291 | A * | 9/1980 | Hunt | 206/222 |
| 4,418,826 | A | 12/1983 | Mancini et al. | |
| 4,487,324 | A * | 12/1984 | Ostrowsky | 215/253 |
| 4,899,897 | A * | 2/1990 | Buttiker et al. | 215/228 |
| 5,018,621 | A * | 5/1991 | O'Connell, Jr. | 206/204 |
| 5,984,123 | A * | 11/1999 | Mogami et al. | 215/235 |
| 2004/0056040 | A1 * | 3/2004 | Ziegler | 220/847 |

FOREIGN PATENT DOCUMENTS

| | | | |
|---|---|---|---|
| BE | 517389 | A | 12/1954 |
| DE | 1642111 | U | 8/1952 |
| DE | 1149660 | B | 5/1963 |
| DE | 19633495 | A1 | 2/1998 |
| DE | 10034119 | A1 | 12/2011 |
| EP | 1352844 | A1 | 10/2003 |
| EP | 1394063 | A1 | 3/2004 |
| EP | 1460000 | | 9/2004 |

* cited by examiner

*Primary Examiner* — Anthony Stashick
*Assistant Examiner* — Andrew T Kirsch
(74) *Attorney, Agent, or Firm* — Greer, Burns & Crain, Ltd.

(57) ABSTRACT

A closure for a container having a support device for fillers, in particular a tablet tube, the support device providing an elastically deformable support element that is capable of being brought from a first position, in which the support element is undeformed, into a second position in which the support element is deformed. The support element has a contact area that, in the second position, transmits a supporting force to the fillers; in the second position the support element is situated closer to the container mid-axis than is the case in the first position.

23 Claims, 4 Drawing Sheets

CLOSURE WITH SUPPORT ARRANGEMENT

BACKGROUND

The present invention relates to a closure for a container, having a support device for the fillers.

Containers of the type under consideration here include in particular cylindrical containers made of plastic or glass, used for example as tubes for tablets. Therefore, the present invention will be explained in relation to the example of containers of this sort. However, the description should not for this reason be understood as limiting; rather, the present invention can also be used for any other containers, e.g. those having non-cylindrical cross-sections.

Such closures have long been known in the prior art, and are widely used for example for closing containers of vitamin tablets or food supplement tablets, as well as pharmaceutical products, whose fragility requires that there be support devices in the container or at the closure in order to ensure delivery of an undamaged product to the consumer. Such support devices according to the prior art generally use elastic elements that, in the delivered state of the closed container, are clamped between the closing cap and the contents and that exert a force on the fillers in the manner of a spring, damping externally caused agitation of the fillers and thus preventing damage to it.

DE 199 36 808 C2 discloses such an elastic element in the form of a bellows that provides segments between the closing cap and the fillers that expand radially and are pushed together axially when the elastic element is deformed, creating an elastic tension.

Such a bellows-type hold-down device is also described in DE-GM 79 29 377 U1. The disadvantages of such a construction include comparatively high material and manufacturing costs. Another disadvantageous property of the bellows construction is that it takes up a relatively large volume inside the container, solely for the purpose of its supporting function. The occupation of such a large volume results in a comparatively high material requirement, and thus in higher costs. In addition, the container volume occupied by the elastic element results in less space for additional devices, such as for example a desiccating capsule for placing desiccating agents in the container.

Another construction of a support device that is widely used, e.g. in stopper closures for vitamin and food supplement tablet tubes, and that is proposed for example in DE-GM 83 37 183.4 U1, as well as in DE 196 33 495 A1, provides a holding down of the fillers in the container via elastically deformable spiral arms. Anchored on the inside of the closing cap, a number of spiral arms, uniformly distributed, wind down to a particular support depth, where usually an annular hold-down device is fastened. The advantage of such a construction is that the interior volume is available for additional functions, such as e.g. a desiccating capsule for introducing a desiccating agent into the container. A further disadvantage is the high material outlay connected with the use of a plurality of spiral arms and an annular hold-down device, resulting in comparatively high material costs.

SUMMARY

The present invention is based on the object of creating a closure having a support device that removes the above-named disadvantages of the prior art, and in particular offers a high degree of user convenience and protection of contents.

The closure according to the present invention achieves the object of the invention by providing, for holding down the fillers of a container having a container mid-axis, a support device having an elastically deformable support element that is capable of being brought from a first position, in which the support element is undeformed, into a second position in which the support element is deformed, whereas the support element has a contact area that, in the second position, transmits a supporting force to the fillers, and, in the second position, said contact area of the support element being situated closer to the container mid-axis than is the case in said first position. Here, the position of the support element in which it is still undeformed, e.g. when the closure is first placed into the completely filled container, is designated the first position.

In the undeformed state, the support element is preferably geometrically oriented in such a way that it at least partly surrounds an imagined geometrical body, in particular a cylinder, the cylinder axis preferably being situated perpendicular to the upper side of the closure.

In the closed state of the container, the cylinder axis preferably coincides with the container mid-axis.

The support element is advantageously constructed of one or more elastically deformable struts that are connected to the inside of the upper part of the closure. Thereby it is possible that the struts are connected to one another.

In order to achieve a low material requirement, a small number of struts is preferably used, additionally preferably having a small material thickness.

Moreover, it is preferably provided to define a directional dependency and overall amount of the elastic deformability of the support element through a material thickness that can be changed dependent on direction, and through the relative position of the struts to one another. Particularly preferably, essentially strip-shaped struts are used whose direction of maximum deformability is essentially perpendicular to the strip surface, this direction preferably being, in the undeformed state, essentially parallel to the surface of the imagined body, in particular of the cylinder.

The struts can have a constant cross-section or can have an outer cross-section that changes along the strut, having a shape selected from a group of shapes including a triangle, a rectangle, a pentagon, a hexagon, or an n-gon, n being any number, and this group of shapes can also include an elliptical structure, an oval structure, or any other structure formed with a curved outer line. In particular for the contact area of the supporting element, a strut cross-section is preferably provided having a curved outer cross-section, in order for example to prevent tilting of the support element in contact with the fillers.

In a preferred embodiment of the closure, the support element has essentially two struts, designated the main support element and the auxiliary support element.

The main support element is essentially formed as an annular loop that is preferably integrally formed in one piece on the inside of the upper part of the closure in a first connecting area, and from there extends out in a plane parallel to the upper part of the closure. The main support element extending outward in this way is supported by the auxiliary support element, which is essentially formed as a two-armed partially annular loop integrally formed in one piece to the inside of the upper part of the closure in the area of a second connecting area and in the plane of the first connecting area, and whose arms extending out from there are each integrally formed in supporting fashion to one side of the annular loop of the main support element. Here, the second connecting area is preferably situated in the position of the first connecting area, mirrored about the axis of the imagined cylinder, and, in the undeformed state of the support element, is preferably situated perpendicular over the contact area of the annular loop of the main support element.

The deformability of the support element in the direction of the cylinder axis is determined at least partly by the deformability of the annular loop in the plane of the surface that it spans. In addition, the deformability in the contact area of the support element has a component pointing in the direction of the cylinder axis. These preferred directions of deformation are supported by the positioning of the auxiliary support element, which makes deformation of the annular loop in a direction parallel to the cylinder axis more difficult and allows its deformation in the plane of the annular loop and perpendicular to the cylinder axis. If a force now acts parallel to the cylinder axis on the contact area of the annular loop, e.g. due to pressing against the surface of a tablet, this annular loop is deformed in the annular loop plane, going out from the contact area in the direction towards the cylinder axis. In the example of the tablet surface, the contact area slides in the direction of the cylinder axis, and beginning from a particular point the strip surface enters into an angle to the cylinder axis that reinforces a sliding away of the contact area in the direction of the cylinder axis. In the closed position of the delivery state of the closure for a container, the support element is preferably in a position in which the contact area is situated essentially on or at least near the cylinder axis.

It is preferably provided that the support element can be integrally connected to the inner surface of the front wall of the upper part of the closure via a spacing element situated essentially parallel to the upper part of the closure. This spacing element preferably has a hollow area; in particular, the spacing element can be constructed essentially as a hollow cylinder.

The hollow area can be used in particular for fastening an additional device. Here, locking means are preferably provided on the interior wall of the spacing element, via which the additional device can be connected form closed and/or force closed to the spacing element and thus to the upper part of the closure. In particular, the locking means on the inner wall of the spacing element can be fashioned as a horizontally circumferential annular rib, and in a number of ribs at a distance running parallel to the cylinder. In addition, in particular the horizontal circumferential rib can be fashioned as a projection on the inner wall of the end of the spacing element facing away from the closure.

The additional device can in particular be a desiccating capsule containing a desiccating agent that acts hygroscopically, and that can counteract an absorption of water by the fillers, e.g. in the delivery state of a container closed by the closure according to the present invention. In particular, the locking means of the spacing element are constructed in such a way that in its hollow area desiccating capsules can be snapped in that are already commercially available, e.g. standard desiccating capsules having corresponding suitable locking means.

In addition, it is preferably provided that the closure be realized in the manner of a stopper closure, but other closure types may also be provided, e.g. screw closures or bayonet closures. The stopper closure preferred in the embodiment has, in the closed position of the container, a circumferential stopper wall that runs concentrically to the inner wall of the container, and protrudes from the inner surface of the front wall of the upper part of the closure and is situated between the spacer element, or support element, and the outer edge of the upper part of the closure. Due to the force-locked engagement of the stopper wall in the outlet opening, the container can preferably be closed in sealing fashion in such a way that under normal conditions of use the penetration of water vapor, gases, or liquids into the container is largely prevented.

The outlet opening of the container preferably has a curved inner line that can preferably be ellipsoid, and more preferably circular. The container preferably has a curved wall, and can in particular have a hollow cylindrical construction.

In another preferred embodiment, the closure has a lower part that can be fashioned as an essentially annular container shoulder, the lower part of the closure preferably concentrically surrounding the outlet opening of the container. On the inside of the lower part of the closure, locking means are preferably provided by means of which the closure can be connected form closed and/or force closed to containers that have complementary locking means. In particular, these locking means can be provided on the lower part of the closure in the form of a circumferential groove and in the area of the outlet opening around the outer wall of the container in the form of a circumferential rib.

In addition, it is preferably provided that the closure has on its upper part and on its lower part means for forming a tamper-evident closure. These means can in particular be fashioned in such a way that on the upper part of the closure there is integrally formed a radially outward-pointing tongue that engages in a window, the window being formed by the opening between a tear-off ring segment situated concentrically around the outside of the lower part of the closure and connected thereto by connecting webs, and the connecting webs. The connecting webs are fashioned as the intended breakpoint, which break when the closure is brought from the original state into the state of use by detaching the tear-off ring segment from the lower part of the closure.

Advantageously, in the closed state of the closure the tongue pointing outward from the upper part of the closure can be used as an opening aid.

In addition, it is provided that preferably a plurality of such tongues and windows, situated concentrically around the upper part of the closure or around the lower part of the closure, are provided in order to form a tamper-evident closure, the tongues preferably being capable of being used as opening aids.

In a particularly preferred embodiment, the closure is constructed in the form of a collapsible closure, in which the upper part of the closure is connected pivotably with the lower part of the closure via a hinge.

In particular for the mostly preferred embodiment of the closure according to the present invention as a collapsible closure, the technical teaching of the present invention proves to be advantageous according to which the support area of the support element is displaced in the direction of the cylinder axis not until in its second position. Because this area close to the axis remains essentially accessible in the first position, more space is available for pivoting the closure and its support device into the outlet opening of the container. Here, the support element is preferably situated with the side of the contact area (i.e., the area protruding furthest from the plane of the upper part of the closure) close to the hinge and therefore close to the outlet opening, so that a large part of the outlet opening at the level of the hinge can be used for the pivoting of the contact area into the outlet opening. This arrangement results in an advantageous maximization of the support depth of the support device, i.e., a maximum possible distance of the contact area from the inner surface of the upper side of the closure.

The hinge of such a collapsible closure is preferably fashioned as a film hinge, i.e., as a connecting web having a low material thickness that connects the two parts of the closure. This connecting web is preferably elastically deformable, so that when the connecting web is deformed a reset force exists that can move the upper part of the closure relative to the lower part of the closure, back into its initial position, which can for example be the position of the completely opened closure.

The technical solution presented above for a closure having a support device provides a construction that can be used flexibly and that saves material and costs. It is also economical if the components of the closure can be manufactured in particular but not exclusively in one piece, from thermoplastic material, for example polyethylene or polypropylene, in the known injection molding method.

BRIEF DESCRIPTION OF THE DRAWINGS

Additional advantages and features of the present invention result from the following description of the exemplary embodiment, in connection with the Figures.

DETAILED DESCRIPTION OF THE PREFERRED EMBODIMENT

Figure 1:
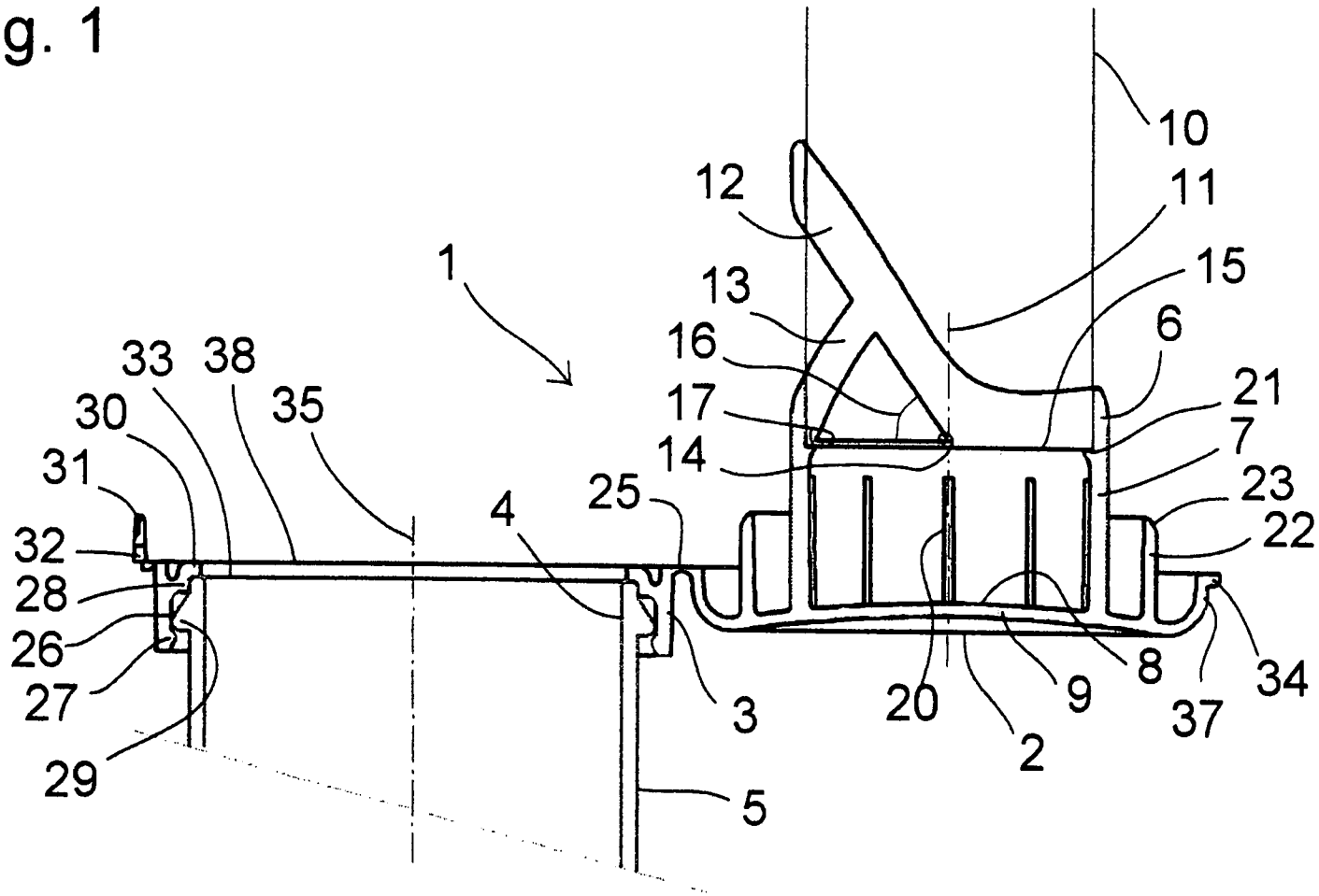
FIG. 1 shows the exemplary embodiment of the closure according to the present invention in the opened state, on a container that is realized as a hollow cylindrical tablet tube.

In the Figures, identical reference characters designate identical or similar parts.

FIGS. 1 to 4 show the exemplary embodiment of a closure according to the present invention having a support device, in the preferred embodiment of the collapsible closure.

FIG. 1 shows the exemplary embodiment of the closure according to the present invention in its particularly preferred specific embodiment as a collapsible closure, having a stopper sealing of the closure and a tamper-evident closure system.

Closure 1 according to the present invention, made up of a closure upper part 2 having an essentially circular outer cross-section and a closure lower part 3, is connected to container 5 by closure lower part 3 at the level of circular outlet opening 4. The closure upper part has a support element 6 that is connected to inner side 8 of front side 9 of the closure upper part via a spacing element 7.

In the exemplary embodiment, the front side is curved slightly in the direction of the support element, in the shape of a funnel. In the exemplary embodiment, the support element partially surrounds an imaginary cylinder 10 having a cylinder axis 11 that stands perpendicular to inner side 8 in the center of the upper part of the closure.

Support element 6 according to the present invention is preferably a construction of struts having a small material thickness that can be connected to one another; in the exemplary embodiment shown in the Figures, essentially two struts are provided, designated main support element 12 and auxiliary support element 13.

Figure 4:
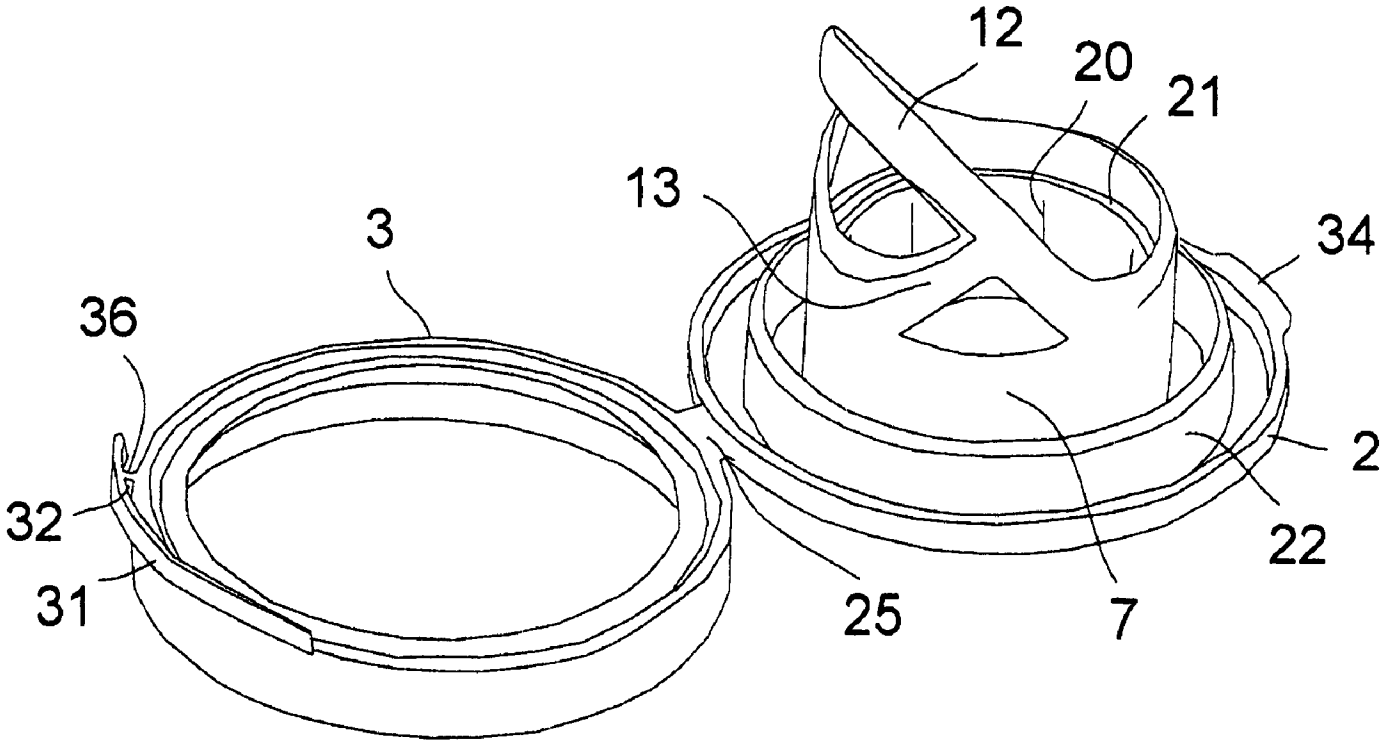
FIG. 4 shows the perspective view of the exemplary embodiment of the closure according to the present invention in the open state.

As can be seen in particular in the perspective view shown in FIG. 4, in the exemplary embodiment main support element 12 is realized as an essentially strip-shaped annular loop that is integrally formed on spacing element 7 and that protrudes at two oppositely situated sides of the spacing element, extending from a first connecting area 14 at an angle 16 from a plane 15 that is situated parallel to the upper side of the closure. The loop, protruding in this way of main support element 12 is supported by an essentially strip-shaped two-armed partially annular loop, the auxiliary support element 13, which, going out from a second connecting area 17 on both sides of the spacing element, is connected in one piece thereto and is connected to the annular loop of the main support element at the upper end of each of the loop arms. Both the annular loop of the main support element and also the partially annular loop of the auxiliary support element can have areas having different material thicknesses. These areas of different material thicknesses influence the deformability or rigidity of the support element according to the present invention.

Spacing element 7 preferably has in the exemplary embodiment locking means in the form of ribs 20 that are situated at a distance from one another in the direction parallel to cylinder axis 11, and has a circumferential rib 21 that runs concentrically around the inside of the end of spacing element 7 facing away from the upper part of the closure. With the spacing element, realized in the exemplary embodiment as a hollow cylinder, a form closed and/or force closed connection can be formed to an additional device, in particular a desiccating capsule. Such a desiccating capsule is used in the original state of the container to protect the fillers from absorbing water.

In the exemplary embodiment, upper part 2 of the closure according to the present invention also has a stopper wall 22 that is fashioned essentially in the shape of a hollow cylinder in order to form a stopper-type seal on inner side 8 of the upper side of the closure, and that has, on its side facing away from the upper part of the closure, a beveling 23 that facilitates the engagement of the stopper wall in outlet opening 4 of container 5. Through the engagement of the stopper wall in the outlet opening, in the closed state the container is sealed in such a way that it is protected against the entry of, for example, water vapor, gases, or liquids.

In addition, the upper part of the closure has a stepped area 37 by which the front side 9 of the upper part of the closure is offset in relation to support plane 38.

Closure upper part 2 is connected to closure lower part 3 by a hinge; in the exemplary embodiment, the hinge is realized as a film hinge 25 that is formed by a connecting web made from the elastic production material having a small thickness. In the exemplary embodiment, this connecting web is elastically deformed when the closure is closed, so that a reset force acts on it that, when the container is opened, effects or at least supports a guiding of the upper part of the closure back into the initial position of FIG. 1.

Lower part 3 of the closure according to the present invention, having an essentially circular outer cross-section, has a circumferential groove 26 that runs concentrically on the inner side of the lower part of the closure, formed on the inner side of the lower part of the closure by protrusions 27 and 28 that run concentrically on the inner surface. In the exemplary embodiment, the container has on its upper edge a circumferential rib 29 by means of which the lower part of the closure, and thus the closure as a whole, can be connected to the container with form closed and/or force closed connection. In addition, the lower part of the closure has on its inner surface on the upper edge a projection 30 by means of which the lower part of the closure can lie against the upper edge of the container, and that defines on its upper side support surface 38.

In addition, in the exemplary embodiment a device is provided for the tamper-evident closure of the closure according to the present invention. For this purpose, on the outside of the lower part of the closure a window 32 is fashioned in a position that corresponds approximately to the position of film hinge 25 mirrored about container mid-axis 35; this window is formed by the opening between the closure lower part 3 and a tear-off ring segment 31 situated concentrically around the outer side of closure lower part 3 and connected thereto by connecting webs 36. In the closed original state of the container, this opening is sealed in that tongue 34 on the outside of closure upper part 2 engages in window 32, and in that in this original state the closure can be opened only by breaking the connecting webs, which are formed as intended breakpoints. Tongue 34, which in the closed state extends from the outer side of the closure, can also be used as an opening aid, in that it offers a starting point for grasping the upper part of the closure in the closed state, and acts as a force-amplifying lever during opening.

In the exemplary embodiment, this tamper-evident closure system is made up of one window and one tongue. However, it is possible for a plurality of windows and tongues to be fashioned in order to form the tamper-evident closure system.

Figure 2:
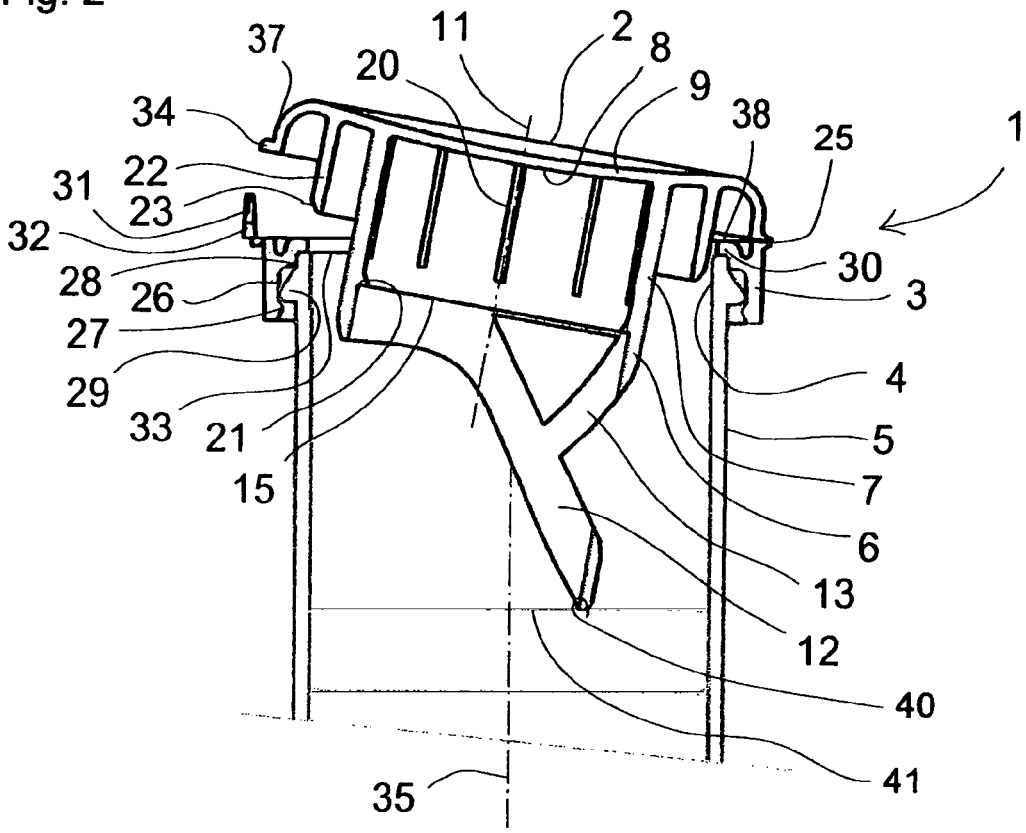
FIG. 2 shows the exemplary embodiment of the closure according to the present invention in the first position of the supporting element on a container realized as a hollow cylindrical tablet tube.

In FIG. 2, the first position of the support element is illustrated in the exemplary embodiment having the closure according to the present invention realized as a collapsible closure. The support element has a contact area 40 that in the undeformed state of the support element defines the point of maximum distance of the support device perpendicular to the support plane 38, and thus defines the maximum support depth of the support device. In this first position of the support element, in the exemplary embodiment contact area 40 impinges on upper surface 41 of a stack of tablets.

Figure 3:
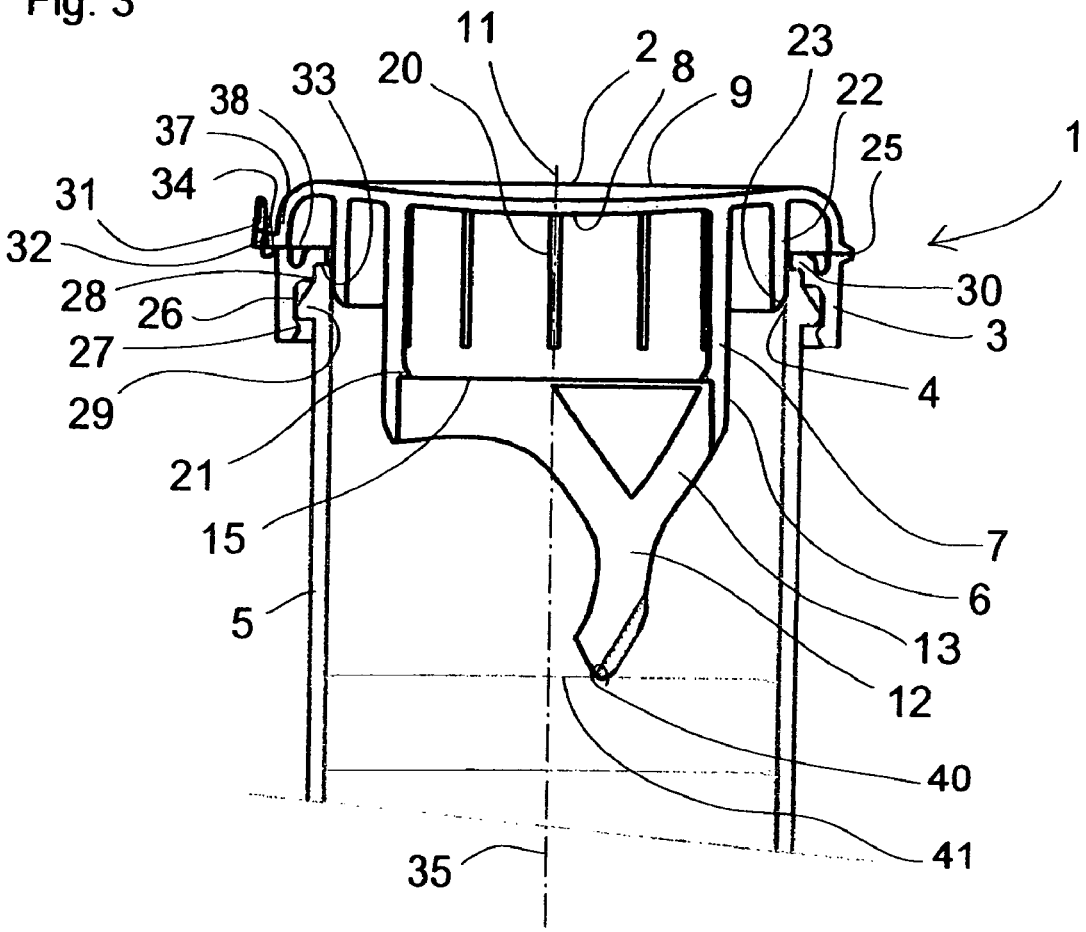
FIG. 3 shows the exemplary embodiment of the closure according to the present invention with the second position of the supporting element on a container that is realized as a hollow cylindrical tablet tube.

As the process of closing the container continues, the pressure force of the stack of tablets deforms annular loop 12 at least partly in the direction of cylinder axis 11, so that at least a partial displacement or sliding of contact area 40 in the direction of container axis 35 takes place. In the completely closed state of the container, e.g. in the original state, in the exemplary embodiment contact area 40 is situated close to container mid-axis 35. In this second position of the support element, main support element 12 of support element 6 is maximally deformed and is deflected in the direction of container mid-axis 35 or cylinder axis 11. This is shown in FIG. 3.

FIG. 4 shows a perspective view of the exemplary embodiment of the closure according to the present invention in its specific embodiment as a collapsible closure, in the opened state of the container, i.e. as in FIG. 1. FIG. 4 illustrates the annular loop of main support element 12, as well as its strip shape. In addition, on the outer side of lower part 3 of the closure, tear-off ring segment 31 can be seen clearly, which is connected to the lower part of the closure by connecting webs 36 and which forms with the connecting webs a window 32 for the engagement of tongue 34, this window and this tongue forming at least a part of the tamper-evident closure device.

The invention claimed is:

1. A closure for a container having a container mid-axis, the closure comprising:

a closure upper part with a lower edge and having a support device for fillers in the container, said support device including:

an elastically deformable support element including an elastically deformable strut which is connected to an inside surface of said closure upper part, said strut being formed as an annular loop extending from said closure upper part;

said support element can be brought from a first position, in which said support element is undeformed, into a second position, in which said support element is deformed upon contact with the fillers in the container;

said support element having a contact area that, in the second position, transmits a supporting force to the fillers;

wherein in said second position, said contact area of said support element is situated closer to the container mid-axis than in said first position.

2. The closure as recited in claim 1, wherein in the undeformed state the support element partially surrounds an imaginary cylinder whose cylinder axis is situated perpendicular to the upper side of the closure.

3. The closure as recited in claim 2, wherein in the closed state of a container the cylinder axis coincides with the container mid-axis.

4. The closure as recited in claim 1, wherein said support element is formed from a number of elastic struts.

5. The closure as recited in claim 4, wherein the struts have a cross-section that can have a shape selected from a group of shapes including a triangle, a rectangle, a pentagon, a hexagon, or an n-gon, n being an arbitrary number; this group of shapes can also include an elliptical structure, an oval structure, or any other structure having a curved outer line.

6. The closure as recited in claim 4, wherein the struts of the support element are configured as strips each having an outer surface that in the undeformed state of the support element, are situated essentially on an outer surface of the imaginary cylinder.

7. The closure as recited in claim 1, wherein said support element has a main support element and an auxiliary support element.

8. The closure as recited in claim 7, wherein said upper part of the closure comprises a front wall and said main support element is fashioned essentially as an annular loop that is integrally formed on said upper part of the closure in the area of a first connecting area, and from there obliquely protrudes from a plane parallel to said front wall of said upper part of the closure, and said auxiliary support element is essentially fashioned as a two-armed partially annular loop that is integrally formed on said upper part of the closure in the area of a second separated connecting area in a plane of the first connecting area, and whose arms protruding from there are each integrally formed in supporting fashion onto a side of said annular loop of said main support element.

9. The closure as recited in claim 1, wherein said support element is integrally connected to an inner surface of said front wall of said upper part of the closure via a spacing element that is situated essentially perpendicular to the cylinder axis.

10. The closure as recited in claim 9, wherein said spacing element has an essentially hollow cylindrical area and has locking means on its inner wall by which an additional device is able to be connected in one of form closed and force closed fashion to said spacing element in said hollow cylindrical area.

11. The closure as recited in claim 10, wherein said locking means are fashioned on said inner wall of said spacing element as a number of ribs that run vertically and a horizontally circumferential annular peripheral rib on its end facing away from said upper part of the closure.

12. The closure as recited in claim 10, wherein said additional device is a desiccating capsule for accommodating a desiccating agent that is able to enter into a form closed and/or force closed locking connection to said locking means of said spacing element by means of complementary locking means.

13. The closure as recited in claim 9, further comprising a stopper wall, situated around said spacing element, protrudes from said inner surface of said front wall of said upper part of the closure, said stopper wall having an outer cross-section having a shape such that the container is able to be closed in sealing fashion by the force closed engagement of said stopper wall in said inner wall of the container.

14. The closure as recited in claim 1, wherein the container has a curved wall, and in particular is fashioned essentially with a hollow cylindrical shape.

15. The closure as recited in claim 1, further comprising a closure lower part that concentrically encloses an outlet opening of the container, locking means being provided in the form of a circumferential groove on said inner wall of a lower part of the closure and a circumferential rib on an outer wall of the container, via which said lower part of the closure is able to be connected to the container.

16. The closure as recited in claim 15, further comprising means for forming a tamper-evident closure on said upper part of the closure and on said lower part of the closure.

17. The closure as recited in claim 16, wherein said upper part of the closure has an integrally formed radially outward-pointing tongue that is provided for engagement in a window that is formed by an opening between a tear-off ring segment situated concentrically around the outer side of said lower part of the closure and is connected thereto by connecting webs, and these connecting webs to said lower part of the closure, said connecting webs being fashioned as an intended breakpoint that breaks when the closure is brought from its original state into the state of use, detaching the tear-off ring segment from said lower part of the closure.

18. The closure as recited in claim 17, wherein in the closed state of the container, the tongue pointing outward from said upper part of the closure is able to be used as an opening aid.

19. The closure as recited in claim 1, wherein a tamper-evident closure is formed by a number of tongues and windows situated concentrically around the closure.

20. The closure as recited in claim 16, wherein said upper part of the closure is pivotably connected to said lower part of the closure via a connecting web having a small material thickness, fashioned in the manner of a film hinge.

21. The closure as recited in claim 1, wherein the components of the closure are manufactured from thermoplastic material, e.g. polyethylene or polypropylene, in the injection molding method.

22. The closure as recited in claim 1, wherein the fillers of the container consist of tablets that are stacked horizontally one over the other in the container.

23. A container, in particular a tablet tube, comprising:

a closure for a container having a container mid-axis and a closure upper part having a support device for fillers in the container, said support device including an elastically deformable support element including an elastically deformable strut which is connected to an inside surface of said closure upper part, said strut being formed as an annular loop extending from said closure upper part;

said support element can be brought from a first position, in which said support element is undeformed, into a second position, in which said support element is deformed upon contact with the fillers in the container;

said support element having a contact area that, in the second position, transmits a supporting force to the fillers;

wherein in said second position, said contact area of said support element is situated closer to the container mid-axis than in said first position.

* * * * *